United States Patent [19]

Turunen et al.

[11] Patent Number: 4,906,521

[45] Date of Patent: Mar. 6, 1990

[54] NON-WOVEN FIBRE PRODUCT

[75] Inventors: Olli Turunen; Kerstin Meinander, both of Porvoo; Johan-Fredrik Selin, Helsinki; Jan Fors, Porvoo; Vidar Eklund, Porvoo; Leo Mandell, Porvoo, all of Finland

[73] Assignee: Neste Oy, Finland

[21] Appl. No.: 235,887

[22] PCT Filed: Dec. 29, 1987

[86] PCT No.: PCT/FI87/00176

§ 371 Date: Aug. 11, 1988

§ 102(e) Date: Aug. 11, 1988

[87] PCT Pub. No.: WO88/05090

PCT Pub. Date: Jul. 14, 1988

[30] Foreign Application Priority Data

Dec. 31, 1986 [FI] Finland ..... 865364

[51] Int. Cl.[4] ..... D04H 1/04; D21H 5/12

[52] U.S. Cl. ..... 428/288; 162/143; 162/146; 162/157.6; 428/290; 428/296; 428/297; 428/393

[58] Field of Search ..... 428/288, 290, 296, 297, 428/393; 162/143, 146, 157.6

[56] References Cited

FOREIGN PATENT DOCUMENTS

WO88/5090 7/1988 PCT Int'l Appl. .

8303433 10/1983 World Int. Prop. O. .

OTHER PUBLICATIONS

International Dissolving and Specialty Pulps Conference Proceedings, K. Ekman et al., 99–104 (1983).

*Primary Examiner*—James C. Cannon

*Attorney, Agent, or Firm*—Steinberg & Raskin

[57] ABSTRACT

A non-woven fibre product in which the fibre material consists, totally or in part, of fibres which are able to form bonds with natural or artificial fibres of the same or different type, and in which said fibres capable of forming bonds are cellulose carbamate fibres.

4 Claims, No Drawings

NON-WOVEN FIBRE PRODUCT

The invention concerns a non-woven fibre product which is totally or partially composed of fibres having bonding properties.

Non-woven fibre products are often porous materials resembling textiles, usually in web or sheet form, and manufactured by a procedure other than the spinning, weaving, knitting and braiding methods commonly employed. The fibres used in producing non-woven fibre products may be natural fibres or synthetic fibres, or mixtures of these. Holding together of the fibre webs may be based on inter-fibre bonding properties, or coherence may be achieved with various bonding agents, and in addition many other bonding methods may be applied in manufacturing said products, e.g. bonding the fibres with the aid of heat or by fusing.

The present invention concerns non-woven fibre webs in which bonding is accomplished by using fibres which possess special bonding properties, these fibres being admixed to the fibre web that has to be bonded, or these fibres constituting the fibre raw material of the fibre product. Usually, bonding fibres used towards such a purpose have been fibres of synthetic origin, for instance polymer fibres, which have been softened, or partly fused, with the aid of chemical or heat treatment in order to achieve bonding properties.

The usability of fibres processing bonding agent properties depends on the fibres to be bonded in general, on the intended use of the product, and on the mechanical strength properties of the product achieved with the bonding agent fibres. Fibres of cellulosic origin possessing bonding properties are, for instance: ground cellulose fibres, cellulose derivative fibres such as carboxymethyl and carboxyethyl cellulose fibres, and viscose fibres prepared by special procedures. Most of the bonding agent fibres have a nature such that they detract from the textile-resembling characteristics of the product. Therefore a considerable need exists in the market of fibres with the aid of which fibre webs made of natural or artificial fibres could be bonded without incurring impaired textile characteristics of the products.

Viscose fibres have long been an important cellulose-based fibre which has been extensively used as fibre raw material for textile-type products. Among the drawbacks of viscose fibres may be noted inadequate wet and dry strengths of the fibre webs made of them if no separate bonding agents or bonding agent fibres are used. The use of viscose fibres is on the decline as a result of the above-mentioned reasons, among others, and moreover for the reason that the procedures applied in manufacturing viscose fibres comprise steps in which substances highly deleterious to environment are used. For this reason considerable need exists in the market of fibres by which could be obtained properties such as porosity, strength, water absorptivity, etc. Particularly, a need exists of fibres which yield said textile properties in fibre products which have been manufactured applying wet procedures.

The present invention concerns a fibre product which contains fibres possessing bonding agent properties. Bonding agent properties are here understood to mean that the fibres possess bonding agent properties in relation to another fibre, or that they possess bonding agent properties in relation to themselves, in which case the fibre product may even be composed exclusively of bonding agent fibres. In the standard case, the effect of the invention is best evident in the case that the fibres to be bonded have no inherent bonding properties. It is also possible, in forming the product, to make use of mechanical procedures which improve, for instance, the wet strength or dry strength of the fibre web or endow it with some other advantageous properties.

The object of the present invention is a non-woven fibre product which totally or partly consists of fibres which are able to form bonds with natural or artificial fibres of the same or different type. One object of the invention is a non-woven fibre product which contains natural or artificial fibres devoid of binding properties and fibres possessing bonding properties. One further object of the invention is to accomplish a non-woven fibre product in which conventionally used and previously known natural or artificial fibres embarrassed by drawbacks have been totally or partly replaced with fibres having no equivalent drawbacks and which furthermore are able to establish bonds with natural or artificial fibres and of which webs can be manufactured on a paper machine.

The non-woven fibre product of the invention of which the fibre material totally or partly consists of fibres which are able to form bonds with natural or artificial fibres of the same or different type is characterized in that said fibres able to form bonds are cellulose carbamate fibres.

The present invention affords a number of substantial advantages. Firstly, cellulose-based artificial fibres commonly used in manufacturing non-woven fibre products, such as viscose rayon fibres, may be totally or partly replaced with cellulose carbamate fibres. By replacing viscose fibres, partly or totally, sufficiently strong products are obtained altogether without using separate bonding agents. The possibility of replacing viscose fibres is an advantage already in itself because the viscose fibre manufacturing process is highly unfriendly to the environment, and therefore a need exists to replace these fibres. Polypropylene fibre is another conventionally used fibre quality which has no strength properties in the absence of bonding effected with bonding agents or by fusing.

As taught by the invention, it is possible to replace advantageously part of the fibres in non-woven fibre webs, for instance 1–90%, with cellulose carbamate fibres, which are able to form bonds with the other fibres in the fibre product. That alternative is also within the sphere of the invention according to which the fibre material of the fibre product is totally replaced with cellulose carbamate. In manufacturing the fibre web, any typical procedure applied in manufacturing non-woven webs may be applied, such as wet procedures, water knitting procedures, etc. Webs may also be formed by carding or by other dry procedures and the webs may be bonded by humidifying. If needed, other auxiliary substances may be added to the web, such as wet-strong resins, fillers, etc.

In the examples following below, the following fibres were used in manufacturing non-woven fibre webs:

Cellulose fibres: pin sulphate cellulose fibres, ground in a laboratory hollander to fineness 20 °SR. The fibres were stored in wet condition between grinding and fibre sheetforming.

Viscose fibres: 1.7 dTex, length 6 mm (manufactured by company Säteri Oy), having the following characteristics:

| | | |
|---|---|---|
| Strength | in air-conditioned state | min. 1.8 |
| | in wet condition | min. 0.9 |
| elongation | in air-conditioned state | max. 25% |
| | in wet condition | max. 32% |
| Water inhibition | | 18–20 g $H_2O$/g |
| Ware retention | | 100–110% |

The carbamate fibres used in the examples had been laboratory spun from cellulose carbamate which had been prepared from bleached cellulose and which hade been irradiated with electron beam treatment to make the cellulose have DP =470. The cellulose was impregnated with an impregnating solution containing ammonia 58% by weight, water 26% by weight and urea 16% by weight. After impregnation, the ammonia was removed by evaporation, and the urea-impregnated fibres were heat-treated at 140° C., during 3 hours. The cellulose carbamate fibres thus obtained had the following characteristics:

| | |
|---|---|
| Nitrogen content | 2.6–2,9% N |
| DP | 280–290 |
| Clogging number (−5° C.) | 220–345 |
| Ball viscosity (20° C.) | 3.6–4-4 Pas |

A spinning solution was prepared of the carbamate fibres, containing 7.3% by weight of cellulose carbamate manufactured as described above, 8% by weight sodium hydroxide and 0.5% by weight zinc oxide. The fibres were spun from this solution into sulphuric acid/-sodium sulphate solution containing sodium sulphate 79–80 g/l and zinc 10.8 g/l. The fibres thus spun presented the following characteristics, after neutralizing and washing:

| | |
|---|---|
| Nitrogen content | 2.18% N |
| dtex | 1.5 |
| Strength | 2.25 cN/dtex |
| Elongation | 8.6% |

EXAMPLE 1

A comparison was made of non-woven fibre products containing cellulose fibres and viscose fibres, respectively cellulose carbamate fibres, made in a sheet mould. The weight per square metre of the sheets thus obtained averaged 60 g/m$^2$. The strength characteristics of the fibre products thus obtained are presented in Table 1.

TABLE 1

| CELL % | VISC % | CARB % | Dry tensile strength, MPa | Elongation % | Wet tensile strength, MPa | Wet elongation % |
|---|---|---|---|---|---|---|
| 75 | — | 25 | 20.1 | 3.1 | 0.95 | 2.5 |
| 75 | 25 | — | 16.7 | 3.6 | 0.57 | 3.2 |
| 67 | — | 33 | 18.9 | 3.3 | 0.94 | 2.9 |
| 67 | 33 | — | 13.0 | 3.3 | 0.46 | 3.5 |
| 50 | — | 50 | 12.5 | 2.7 | 0.72 | 2.6 |
| 50 | 50 | — | 5.6 | 2.5 | 0.30 | 3.7 |
| 33 | — | 67 | 18.9 | 3.3 | 0.94 | 2.9 |
| 33 | 67 | — | 10.8 | 2.4 | 0.62 | 2.4 |

CELL = Cellulose
VISC = Viscose
CARB = Cellulose carbamate

The results in Table 1 show that by using cellulose carbamate fibres one obtains substantially better strength characteristics than by using viscose fibres; therefore, viscose fibres are advantageously replaceable with cellulose carbamate fibres, and better strength characteristics are obtained in addition.

EXAMPLE 2

Such non-woven fibre products made in a sheet mould were compared in which the fibres were mixtures of viscose fibres and cellulose carbamate fibres. The average weight per square metre of the sheets was 29.6 g/m$^2$. The strength characteristics of the fibre products thus obtained are presented in Table 2.

TABLE 2

| CELL % | VISC % | CARB % | Dry tensile strength, MPa | Elongation, % |
|---|---|---|---|---|
| — | — | 100 | 12.8 | 1.4 |
| — | 50 | 50 | 2,38 | 0.6 |
| — | 80 | 20 | 0.37 | 0.5 |

CELL = Cellulose
VISC = Viscose
CARB = Cellulose carbamate

Table 2 reveals that the higher the proportion of viscose fibres replaced, as taught by the invention, with cellulose carbamate fibres, the better the strength characteristics that will be obtained.

EXAMPLE 3

The influence on the strength characteristics of non-woven sheets made of cellulose carbamate fibres elicited with wet-strong resin was studied. The sheets had average weight per m$^2$, 33 g/m$^2$. Wet-strong resin of "Kymmene 558" brand was added to the cellulose fibres at 1% by weight, followed by heating for 1 hour. The strength characteristics of the products thus obtained are presented in Table 3.

TABLE 3

| Temperature | Wet tensile strength, MPa | Wet elongation, % | Dry tensile strength, MPa | Dry elongation, % |
|---|---|---|---|---|
| 20 | 0.40 | 1.8 | 8.7 | 0.9 |
| 105 | 1.07 | 3.4 | 9.9 | 1.1 |
| 130 | 1.33 | 4.1 | 11.9 | 1.5 |
| 140 | 1.95 | 5.3 | 12.1 | 1.6 |

The results show that conventionally used additives increasing the wet strength are also usable when bonding agent fibres according to the invention are being used.

We claim:

1. A non-woven fibre product in which the fibre material consists totally or partly of fibres which are able to form bonds with natural or artificial fibres of the same or different type, characterized in that said fibres capable of forming bonds are cellulose carbamate fibres.

2. Non-woven fibre product according to claim 1, characterized in that said natural fibres have been selected from the group: cellulose, hemp, wool, cotton.

3. Non-woven fibre product according to claim 1, characterized in that the artificial fibre has been selected from the group: viscose, cellulose acetate, polypropylene, polyester, polyamide.

4. Non-woven fibre product according to claim 1, characterized in that it contains, in addition, wet-strong resin.

* * * * *